US006189335B1

(12) United States Patent
Ebara et al.

(10) Patent No.: US 6,189,335 B1
(45) Date of Patent: Feb. 20, 2001

(54) MULTI-STAGE COMPRESSING REFRIGERATION DEVICE AND REFRIGERATOR USING THE DEVICE

(75) Inventors: Toshiyuki Ebara; Yoshio Ishiai; Takeo Komatsubara; Masaya Tadano, all of Gunma-ken (JP)

(73) Assignee: Sanyo Electric Co., Ltd., Osaka (JP)

( * ) Notice: Under 35 U.S.C. 154(b), the term of this patent shall be extended for 0 days.

(21) Appl. No.: 09/236,042

(22) Filed: Jan. 22, 1999

(30) Foreign Application Priority Data

Feb. 6, 1998 (JP) ..... 10-041093
Feb. 9, 1998 (JP) ..... 10-042812
Feb. 10, 1998 (JP) ..... 10-028719

(51) Int. Cl.[7] ..... F25B 1/10
(52) U.S. Cl. ..... 62/510; 62/199; 62/513; 62/524
(58) Field of Search ..... 62/199, 513, 113, 62/524, 511, 510

(56) References Cited

U.S. PATENT DOCUMENTS 3,577,742 * 5/1971 Kocher ..... 62/199
3,808,827 * 5/1974 Avon et al. ..... 62/59
4,317,335 * 3/1982 Nakagawa et al. ..... 62/199
4,416,119 * 11/1983 Wilson et al. ..... 62/149
4,435,962 * 3/1984 Mochizuki et al. ..... 62/175
4,474,026 * 10/1984 Mochizuki et al. ..... 62/157
4,748,820 6/1988 Shaw ..... 62/175
5,092,138 * 3/1992 Radermacher et al. ..... 62/502
5,094,085 3/1992 Irino ..... 62/175
5,095,712 * 3/1992 Narreau ..... 62/113
5,235,820 * 8/1993 Radermacher et al. ..... 62/114

* cited by examiner

*Primary Examiner*—Corrine McDermott
*Assistant Examiner*—Marc Norman
(74) *Attorney, Agent, or Firm*—Darby & Darby

(57) ABSTRACT

There is disclosed a multi-stage compressing refrigeration device for multi-stage compressing a refrigerant using a plurality of compressing means. Its object is to enhance reliability, intend to reduce input and improve refrigeration effect, and to enhance efficiency. In the multi-stage compressing refrigeration device, low-stage compressing means and high-stage compressing means, a condenser, first expanding means, an intermediate evaporator, second expanding means and a main evaporator constitute a refrigeration cycle. The refrigerant flowing out of the condenser is branched into one refrigerant passed to the intermediate evaporator via the first expanding means and the other refrigerant passed to the main evaporator via the second expanding means. Heat exchange is performed between the refrigerant flowing into the second expanding means and the intermediate evaporator. Additionally, the refrigerant flowing out of the main evaporator is sucked by the low-stage compressing means, and the refrigerant flowing out of the intermediate evaporator is sucked by the high-stage compressing means together with the refrigerant discharged from the low-stage compressing means.

7 Claims, 10 Drawing Sheets

MULTI-STAGE COMPRESSING REFRIGERATION DEVICE AND REFRIGERATOR USING THE DEVICE

BACKGROUND OF THE INVENTION

The present invention relates to a multi-stage compressing refrigeration device for compressing a refrigerant in multiple stages using a plurality of compressing means.

DESCRIPTION OF THE RELATED ART

For a conventional refrigeration device for use in a refrigerator, an air conditioner, and the like, as disclosed in Japanese Patent Publication No. 30743/1995 (F04C23/00), a rotary type compressor is used, in which two compressing means each comprising a rotary cylinder and a roller rotating inside the cylinder are contained in the same closed container. The compressing means are operated as low-stage and high-stage compressing means. The refrigerant gas compressed in one stage by the low-stage compressing means is sucked by the high-stage compressing means, so that the refrigerant is multi-stage compressed.

According to the multi-stage compressing refrigeration device, there is an advantage that a high compression ratio can be obtained while the torque fluctuation in one compressing operation is suppressed.

However, especially when a refrigerant having a high specific heat ratio is used in the conventional multi-stage compressing refrigeration device, the temperature of the gas refrigerant of the low-stage compressing means sucked by the high-stage compressing means is raised, and input is disadvantageously raised. Moreover, the temperature of the gas refrigerant discharged from the high-stage compressing means is also raised. Therefore, when ester oil (e.g., polyol ester or POE) is used as a lubricating oil, the lubricating oil causes hydrolysis by heat, and acid and alcohol are generated. Since sludge is generated as the acid, a capillary tube is disadvantageously clogged, while lubricating properties are deteriorated.

Moreover, since the refrigeration effect is also lowered, efficiency (result coefficient) is disadvantageously deteriorated.

Furthermore, during pull-down when equipment is installed or in another transient condition, even if multi-stage compression is performed, the enhancement of efficiency cannot be expected. On the contrary, when operation by one-stage compression of each compressing means is performed, the displacement volume is increased, and an efficient operation can be realized. Conversely, during night-time or in another low-load condition, multi-stage compression is unnecessary.

On the other hand, in a conventional household refrigerator provided with a cold storage chamber and a freezing chamber, air cooled by an evaporator usually installed on the side of the freezing chamber is circulated in each chamber for cooling. In this case, the temperature of the freezing chamber is controlled by controlling a compressor, but the temperature of the cold storage chamber is controlled by regulating the circulation amount of cool air flowing into the freezing chamber. Therefore, the temperature of the freezing chamber should be subordinate to the temperature of the freezing chamber.

To solve the problem, there is proposed a device in which freezing and cold storage chambers are provided with freezing and cold storage chamber evaporators, respectively, so that each chamber is directly cooled by the evaporator installed therein. In this case, when the refrigerant is supplied to the evaporators by one ordinary compressor, pressure adjustment becomes difficult, while refrigeration effect and operation efficiency are disadvantageously deteriorated.

SUMMARY OF THE INVENTION

The present invention has been developed to solve the aforementioned conventional technical problems, and an object thereof is to provide a multi-stage compressing refrigeration device in which a plurality of compressing means are used to compress a refrigerant in multiple stages, so that reliability is enhanced, input is reduced, refrigeration effect is improved, and efficiency is increased.

In the multi-stage compressing refrigeration device of the present invention, low-stage compressing means and high-stage compressing means, a condenser, first expanding means, an intermediate evaporator, second expanding means and a main evaporator constitute a refrigeration cycle. A refrigerant flowing out of the condenser is branched into one refrigerant passed to the intermediate evaporator via the first expanding means and the other refrigerant passed to the main evaporator via the second expanding means. Heat exchange is performed between the refrigerant flowing into the second expanding means and the intermediate evaporator, the refrigerant flowing out of the main evaporator is sucked by the low-stage compressing means, and the refrigerant flowing out of the intermediate evaporator is sucked by the high-stage compressing means together with the refrigerant discharged from the low-stage compressing means.

According to the present invention, the low-stage and high-stage compressing means, the condenser, the first expanding means, the intermediate evaporator, the second expanding means and the main evaporator constitute the refrigeration cycle. The refrigerant flowing out of the condenser is branched in one refrigerant passed to the intermediate evaporator via the first expanding means and the other refrigerant passed to the main evaporator via the second expanding means. Additionally, the refrigerant flowing out of the main evaporator is sucked by the low-stage compressing means, and the refrigerant flowing out of the intermediate evaporator is sucked by the high-stage compressing means together with the refrigerant discharged from the low-stage compressing means. Therefore, while the torque fluctuation in one compressing operation in the compressor is suppressed, a high compression ratio can be obtained. Additionally, the temperature of the gas refrigerant sucked by the high-stage compressing means can be lowered. Therefore, input reduction can be attained. Moreover, the temperature of the gas refrigerant discharged from the high-stage compressing means is also lowered. For example, even when ester oil is used as a lubricating oil, the generation of POE problem or the deterioration of lubricating properties can be prevented.

Especially, since the heat exchange is performed between the refrigerant flowing into the second expanding means and the intermediate evaporator, the refrigeration effect is increased relative to the refrigerant circulation amount in the main evaporator. Therefore, the efficiency can be enhanced.

Here, FIG. 4 shows the relationship of a ratio D2/D1 of displacement volume D1 of the low-stage compressing means and displacement volume D2 of the high-stage compressing means and the result coefficient. As clearly seen from FIG. 4, the result coefficient exhibits a mountain-shaped characteristic with the vicinity of the displacement volume ratio D2/D1 of 30% (0.3) being a peak.

Subsequently, the throttle amount of the first expanding means is changed to change the refrigerant temperature in the intermediate evaporator. When the peak value on the curve of FIG. 4 in each refrigerant temperature is plotted as shown in FIG. 6, a mountain-shaped characteristic is obtained as shown in FIG. 5 or 6. A line shown in the lowermost portion of FIG. 6 shows the result coefficient of one-stage compressing refrigeration device.

Specifically, FIG. 5 or 6 shows the relationship of the refrigerant temperature in the intermediate evaporator and the result coefficient. Additionally, since the refrigerant temperature in the intermediate evaporator is set in the range of −10° C. to +25° C. in the present invention, as clearly seen from FIG. 6, the result coefficient can remarkably be improved as compared with the one-stage compressing refrigeration device.

Moreover, in the multi-stage compressing refrigeration device of the present invention, the ratio D2/D1 of the displacement volume D1 of the low-stage compressing means and the displacement volume D2 of the high-stage compressing means is set in the range of 0.35±0.15.

As clearly seen from FIG. 4, the result coefficient forms the mountain-shaped characteristic with the vicinity of the displacement volume ratio D2/D1 of 30% being the peak. Additionally, in the present invention, the ratio D2/D1 of the displacement volume D1 of the low-stage compressing means and the displacement volume D2 of the high-stage compressing means is set in the range of 0.35±0.15. Therefore, the result coefficient is further improved as compared with the one-stage compressing refrigeration device, and the efficiency can be enhanced.

Furthermore, in a refrigerator using the multi-stage compressing refrigeration device of the present invention, an electric motor and a compressing element operated by the electric motor are installed in a single closed container. The compressing element is provided with a compressor constituted by a low-stage compressing section and a high-stage compressing section, and a refrigeration cycle constituted by the low-stage and high-stage compressing sections of the compressor, a condenser, first expanding means, a cold storage chamber evaporator, second expanding means and a freezing chamber evaporator. A refrigerant flowing out of the condenser is branched into one refrigerant passed to the cold storage chamber evaporator via the first expanding means and the other refrigerant passed to the freezing chamber evaporator via the second expanding means. Heat exchange is performed between the refrigerant flowing into the second expanding means and the cold storage chamber evaporator, the refrigerant flowing out of the freezing chamber evaporator is sucked by the low-stage compressing section, and the refrigerant flowing out of the cold storage chamber evaporator is sucked by the high-stage compressing section together with the refrigerant discharged from the low-stage compressing section.

Furthermore, in the multi-stage compressing refrigeration device of the present invention, low-stage compressing means, high-stage compressing means, a condenser, primary expanding means, an accumulator, secondary expanding means and an evaporator are successively interconnected in a circular shape to constitute a refrigeration cycle and to selectively perform a first mode in which a refrigerant discharged from the high-stage compressing means is successively passed through the condenser, the primary expanding means, the accumulator, the secondary expanding means and the evaporator and sucked by the high-stage compressing means; a second mode in which a refrigerant discharged from the low-stage compressing means is successively passed through the condenser, the primary expanding means, the accumulator, the secondary expanding means and the evaporator and sucked by the low-stage compressing means; a third mode in which refrigerants discharged from the high-stage and low-stage compressing means are successively passed through the condenser, the primary expanding means, the accumulator, the secondary expanding means and the evaporator, branched and sucked by the high-stage and low-stage compressing means, respectively; and a fourth mode in which a refrigerant discharged from the high-stage compressing means is successively passed through the condenser, the primary expanding means and the accumulator, a liquid refrigerant in the accumulator is passed to the evaporator via the secondary expanding means and sucked by the low-stage compressing means, a refrigerant discharged from the low-stage compressing means is sucked by the high-stage compressing means, and a saturated gas refrigerant in the accumulator is sucked by the high-stage compressing means together with the refrigerant discharged from the low-stage compressing means.

Additionally, in the multi-stage compressing refrigeration device of the present invention, the gas-liquid separation temperature in the accumulator is set in the range of −5° C. to +25° C. in the same manner as described above.

Furthermore, in the multi-stage compressing refrigeration device of the present invention, the ratio D2/D1 of the refrigeration device D1 of the low-stage compressing means and the refrigeration device D2 of the high-stage compressing means is set in the range of 0.35±0.1.

DETAILED DESCRIPTION OF THE PREFERRED EMBODIMENT

Figure 1:
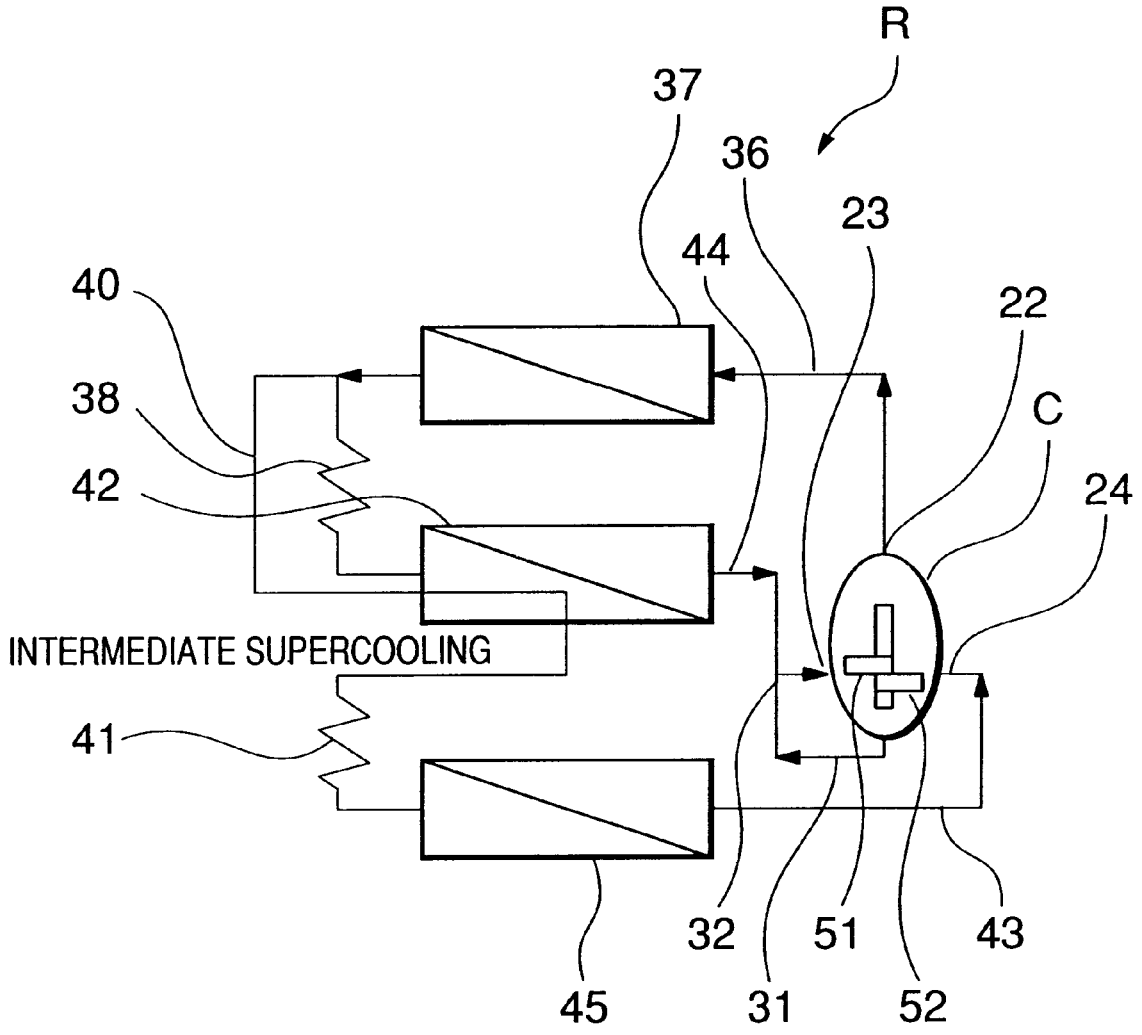
FIG. 1 is a refrigerant circuit diagram of a multi-stage compressing refrigeration device of the present invention.
Figure 2:
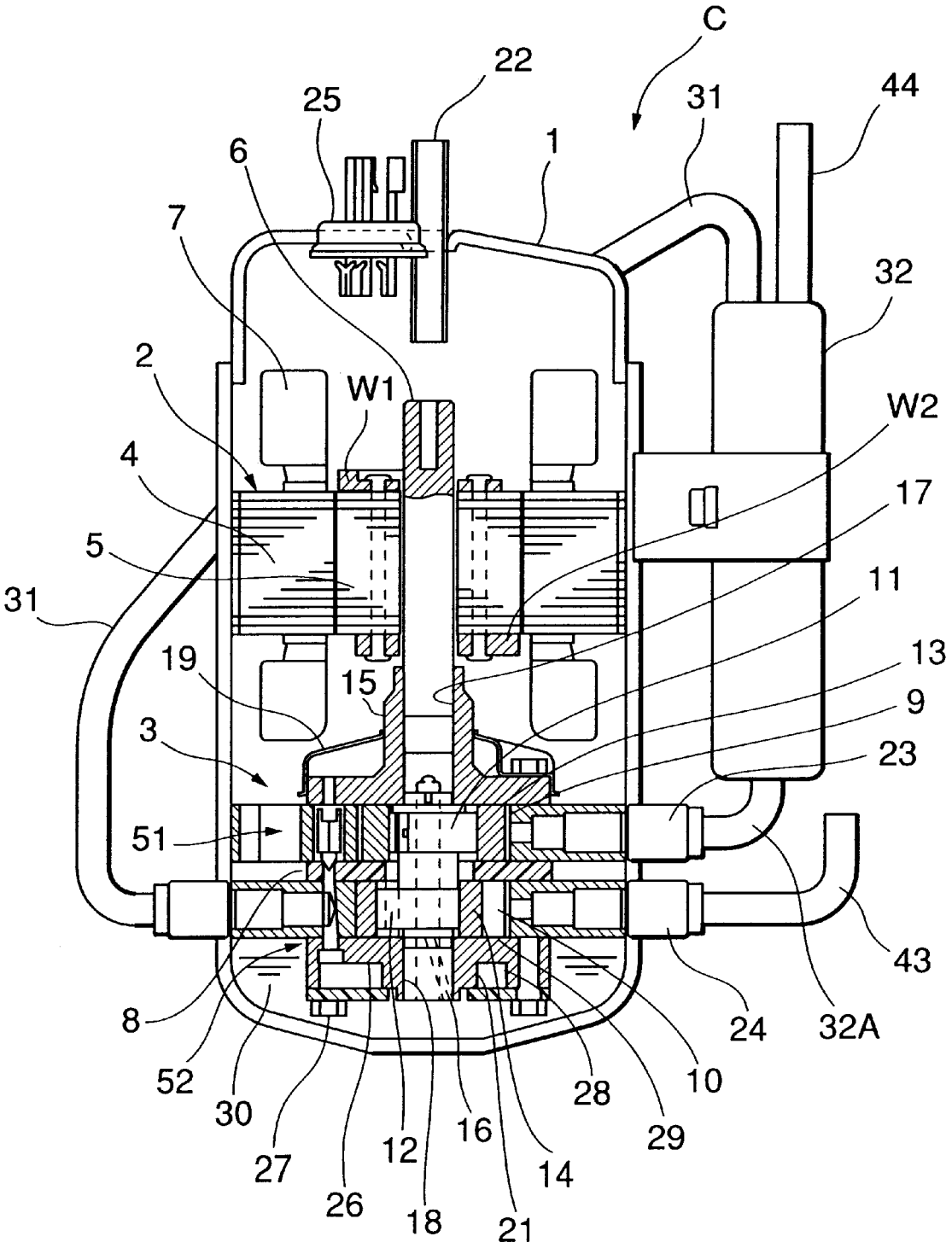
FIG. 2 is a vertical sectional view of a compressor applied to the present invention.

Embodiments of the present invention will be described below in detail with reference to the accompanying drawings. FIG. 1 is a refrigerant circuit diagram of a multi-stage compressing refrigeration device R of the present invention, and FIG. 2 is a vertical sectional view of a rotary compressor C applied to the present invention. First referring to FIG. 2, numeral 1 denotes a closed container, in which an electric motor (brushless DC motor) 2 is contained in an upper section, and a compressing element 3 rotated/operated by the electric motor 2 is contained in a lower section. After the electric motor 2 and the compressing element 3 are contained in two chambers divided beforehand, the closed container 1 is sealed by high-frequency welding or the like.

The electric motor 2 is constituted of a stator 4 fixed to the inner wall of the closed container 1, and a rotor 5 rotatably supported around a rotating shaft 6 inside the stator 4. The stator 4 is provided with a stator winding 7 for providing the rotor 5 with rotating magnetic field. Additionally, W1, W2 denote balance weights attached to upper and lower surfaces of the rotor 5.

The compressing element 3 is provided with a first rotary cylinder 9 and a second rotary cylinder 10 which are partitioned with an intermediate partition plate 8. Eccentric portions 11, 12 rotated/operated by the rotating shaft 6 are attached to the cylinders 9, 10, and the eccentric positions of the eccentric portions 11, 12 are deviated in phase from each other by 180 degrees.

First and second rollers 13, 14 are rotated in the cylinders 9, 10 when the eccentric portions 11, 12 are rotated. Numerals 15, 16 denote first and second frames. A closed compression space of the cylinder 9 is formed between the first frame 15 and the intermediate partition plate 8, while a closed compression space of the cylinder 10 is similarly formed between the second frame 16 and the intermediate partition plate 8. Moreover, the first and second frames 15, 16 are provided with bearings 17, 18 for rotatably supporting the lower portion of the rotating shaft 6.

A high-stage compressing section 51 (high-stage compressing means) is formed by the upper cylinder 9, the eccentric portion 11, the roller 13, a vane (not shown) for defining high and low pressure chambers in the cylinder 9, and the like. A low-stage compressing section 52 (low-stage compressing means) is formed by the lower cylinder 10, the eccentric portion 12, the roller 14, a vane (not shown) for defining high and low pressure chambers in the cylinder 10, and the like.

Moreover, when the displacement volume of the low-stage compressing section 52 is D1, and the displacement volume of the high-stage compressing section 51 is D2, the displacement volume ratio D2/D1 is set in the range of 0.35±0.15.

A discharge muffler 19 is attached to cover the first frame 15. The cylinder 9 and the discharge muffler 19 are interconnected via a discharge hole (not shown) formed in the first frame 15.

On the other hand, a recess 21 is formed in the second frame 16, and an expansion type sound damper 28 is formed by closing the recess 21 with a lid 26 and fixing the lid 26 integrally with the second frame 16 onto the cylinder 10 with a bolt 27. The second frame 16 is provided with a discharge port 29 for connecting the cylinder 10 and the recess 21.

Additionally, the second frame 16 is positioned in the lowermost section in the closed container 1, and an oil reservoir 30 for storing lubricating oil is formed around the second frame 16. Since the surrounding of the second frame 16 is thus filled with the lubricating oil, there is no danger that high-pressure gas in the closed container 1 leaks into the expansion type sound damper 28. Therefore, the deterioration of performance by a decrease of refrigerant circulation amount can be prevented.

The discharge port 29 is connected to a piping 31 drawn out of the closed container 1, and the piping 31 is inserted from above into a flow combiner 32 provided outside the closed container 1 to open into the flow combiner 32. Moreover, an exit piping 32A on the lower end of the flow combiner 32 is connected to a suction pipe 23 leading to the cylinder 9.

On the other hand, a discharge pipe 22 is provided on the closed container 1, while a suction pipe 24 is connected to the cylinder 10. Moreover, a closing terminal 25 is provided for supplying electric power to the stator winding 7 of the stator 4 from the outside of the closed container 1 (a lead wire connecting the closing terminal 25 and the stator winding 7 is not shown).

Additionally, in the refrigerant circuit of FIG. 1, the discharge pipe 22 of the compressor C constituting the refrigeration device R is connected to the entrance of a condenser 37 via a piping 36. The exit side of the condenser 37 is branched into two ways: one way is connected to a capillary tube 38 as the first expanding means; and the other way forms a branched piping 40, which is heat-exchangeably passed through an intermediate evaporator 42 and then connected to a capillary tube 41 as the second expanding means.

The exit of the capillary tube 38 is connected to the intermediate evaporator 42. A piping 44 on the exit side of the intermediate evaporator 42 is inserted into the flow combiner 32 from above to open inside. Moreover, a main evaporator 45 is connected to the exit of the capillary tube 41, and a piping 43 connected to the exit of the main evaporator 45 is connected to the suction pipe 24 of the compressor C.

The refrigeration cycle of the multi-stage compressing refrigeration device R is constituted as described above. The predetermined amount of HFC refrigerant or HC refrigerant such as R-134*a* is sealed in the refrigerant circuit of the multi-stage compressing refrigeration device R, and examples of lubricating oil include ester oil, ether oil, alkyl benzene oil, mineral oil, and the like. In the embodiment, R-134*a* is used as the refrigerant, and the ester oil is used as the lubricating oil.

The operation of the aforementioned constitution will next be described. When the electric motor 2 is operated, the low-stage compressing section 52 sucks the refrigerant via the suction pipe 24 to perform compression (first-stage compression), and discharges the refrigerant to the piping 31 from the discharge port 29 via the expansion type sound damper 28. The one-stage compressed gas refrigerant discharged via the piping 31 is sucked by the high-stage compressing section 51 from the suction pipe 23 via the flow combiner 32. The two-stage compressed gas refrigerant subjected to compression (second-stage compression) is discharged to the discharge muffler 19 via the discharge hole, and further discharged into the closed container 1 via the discharge muffler 19.

The two-stage compressed gas refrigerant discharged into the closed container 1 is discharged to the piping 36 via the discharge pipe 22. The refrigerant then flows into the condenser 37, in which heat dissipation and condensation are performed. Thereafter, the refrigerant is discharged from the condenser 37 and branched. In one branched path, after the pressure reduction is performed in the capillary tube 38, the refrigerant flows into the intermediate evaporator 42 to evaporate.

At this time, the intermediate evaporator 42 fulfills its cooling action by taking heat from its surrounding. Additionally, the throttle amount of the capillary tube 38 is selected in such a manner that the temperature of the evaporated refrigerant is in the range of −10° C. to +25° C.

The low-temperature gas refrigerant flowing out of the intermediate evaporator 42 is passed through the exit side piping 44 to flow into the flow combiner 32. After the refrigerant meets the one-stage compressed gas refrigerant discharged from the low-stage compressing section 52 as described later, the refrigerants are sucked into the high-stage compressing section 51 via the suction pipe 23 and compressed again.

On the other hand, the liquid refrigerant flowing into the branched piping 40 via the condenser 37 is supercooled while being passed through the intermediate evaporator 42, and its pressure is reduced in the capillary tube 41. The refrigerant then flows into the main evaporator 45 to evaporate therein. The main evaporator 45 fulfills its cooling action by taking heat from its surrounding. The low-temperature gas refrigerant flowing out of the main evaporator 45 is passed through the piping 43 to return to the compressor C, and sucked again by the low-stage compressing section 52 via the suction pipe 24.

The one-stage compressed gas refrigerant discharged from the low-stage compressing section 52 meets the low-temperature gas refrigerant flowing out of the intermediate evaporator 42 in the flow combiner 32 as described above. Subsequently, the refrigerants are sucked by the high-stage compressing section 51 via the suction pipe 23, and compressed again.

As described above, in the present invention, the low-stage compressing section 52 and the high-stage compressing section 51 of the compressor C, the condenser 37, the capillary tube 38, the intermediate evaporator 42, the capillary tube 41 and the main evaporator 45 constitute a refrigeration cycle. The refrigerant flowing out of the condenser 37 is branched into one refrigerant passed to the intermediate evaporator 42 via the capillary tube 38 and the other refrigerant passed to the main evaporator 45 via the capillary tube 41. Additionally, the refrigerant flowing out of the main evaporator 45 is sucked by the low-stage compressing section 52, and the refrigerant flowing out of the intermediate evaporator 42 is sucked by the high-stage compressing section 51 together with the refrigerant discharged from the low-stage compressing section 52. Therefore, while the torque fluctuation in one compressing operation in the compressor C is suppressed, a high compression ratio can be obtained. Additionally, the temperature of the gas refrigerant sucked by the high-stage compressing section 51 can be lowered, and input can be reduced.

Moreover, the temperature of the gas refrigerant discharged from the high-stage compressing section 51 is also lowered. For example, even when ester oil is used as the lubricating oil, the generation of POE problem and the deterioration of lubricating properties can be prevented.

Figure 3:
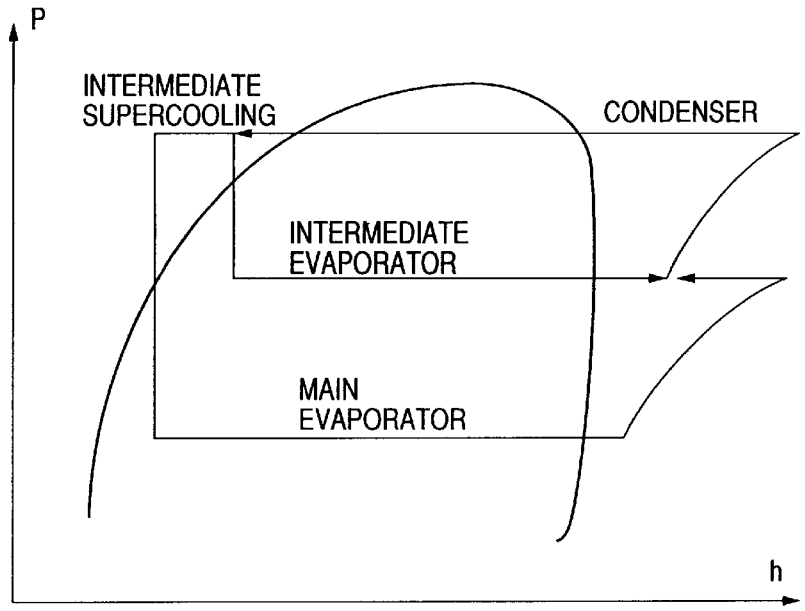
FIG. 3 is Mollier chart of the multi-stage compressing refrigeration device of the present invention.

Especially, since heat exchange is performed between the refrigerant flowing into the capillary tube 41 and the intermediate evaporator 42, the refrigeration effect relative to the refrigerant circulation amount in the main evaporator 45 is increased, and efficiency can be enhanced (refer to Mollier chart of FIG. 3).

Figure 4:
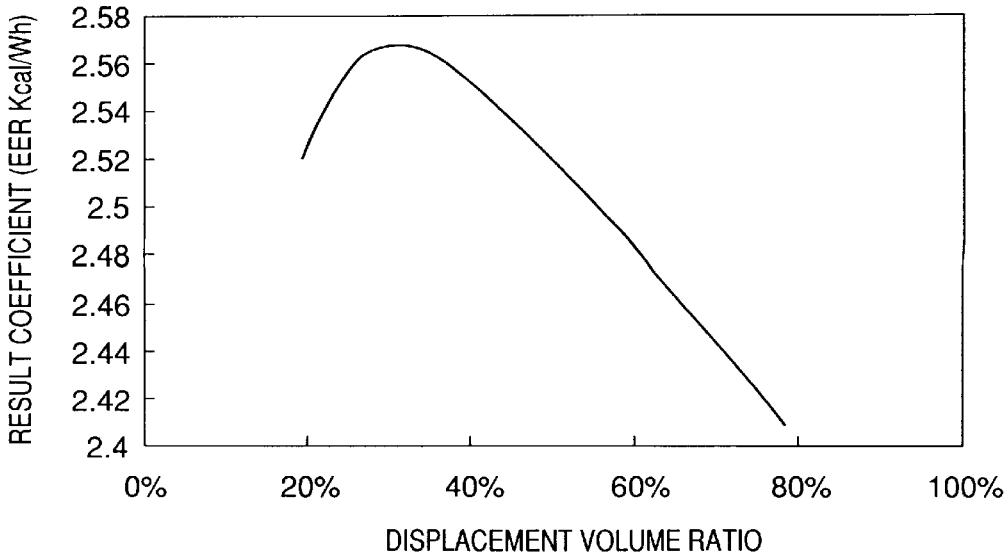
FIG. 4 is a graph showing the relationship of a displacement volume ratio of a low-stage compressing section (low-stage compressing means) and a high-stage compressing section (high-stage compressing means) and a result coefficient.

Here, the relationship of the ratio D2/D1 of the displacement volume D1 of the low-stage compressing section 52 and the displacement volume D2 of the high-stage compressing section 51 and the result coefficient is shown in FIG. 4. As clearly seen from FIG. 4, the result coefficient exhibits a mountain-shaped characteristic with the vicinity of displacement volume ratio D2/D1 of 30% (0.3) being its peak.

Subsequently, the throttle amount of the capillary tube 38 is changed to change the refrigerant temperature in the intermediate evaporator 42. When the peak value of the curve of FIG. 4 in each refrigerant temperature is plotted as shown in FIG. 6, a mountain-shaped characteristic is obtained as shown in FIG. 5 or 6.

Figure 5:
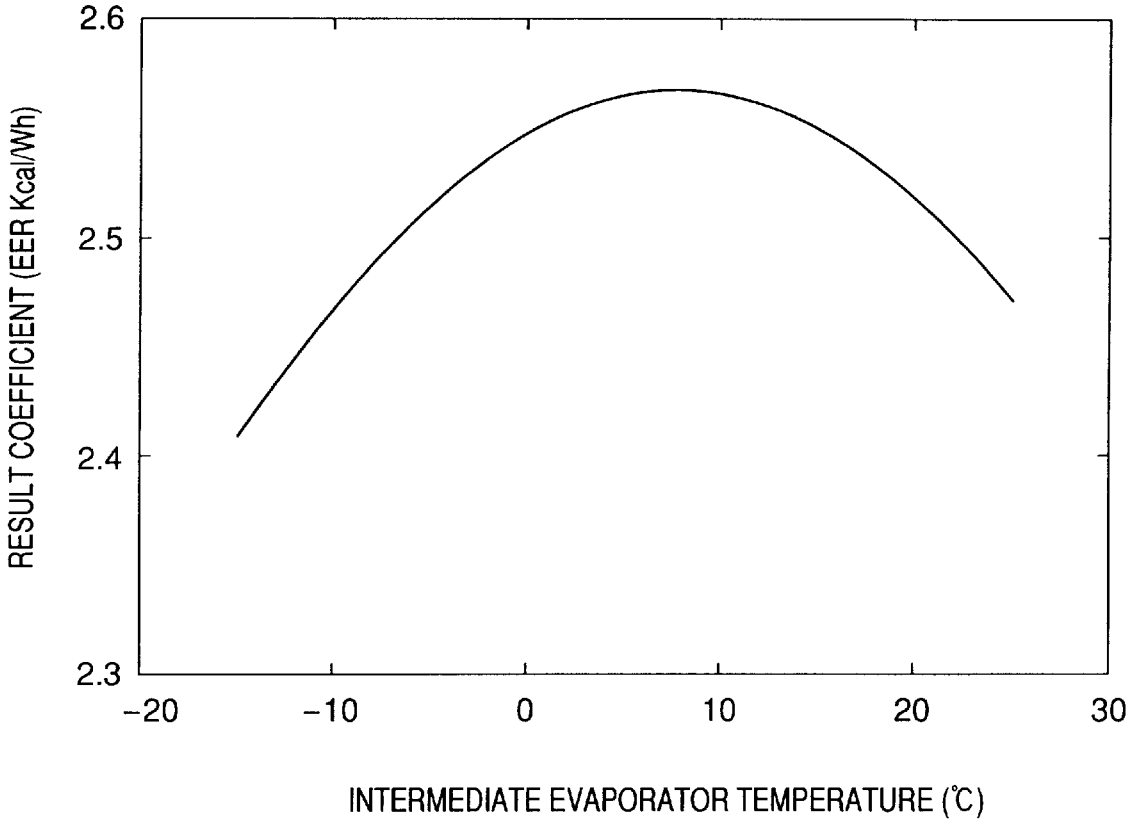
FIG. 5 is a graph showing the relationship of a refrigerant temperature in an intermediate evaporator and the result coefficient.
Figure 6:
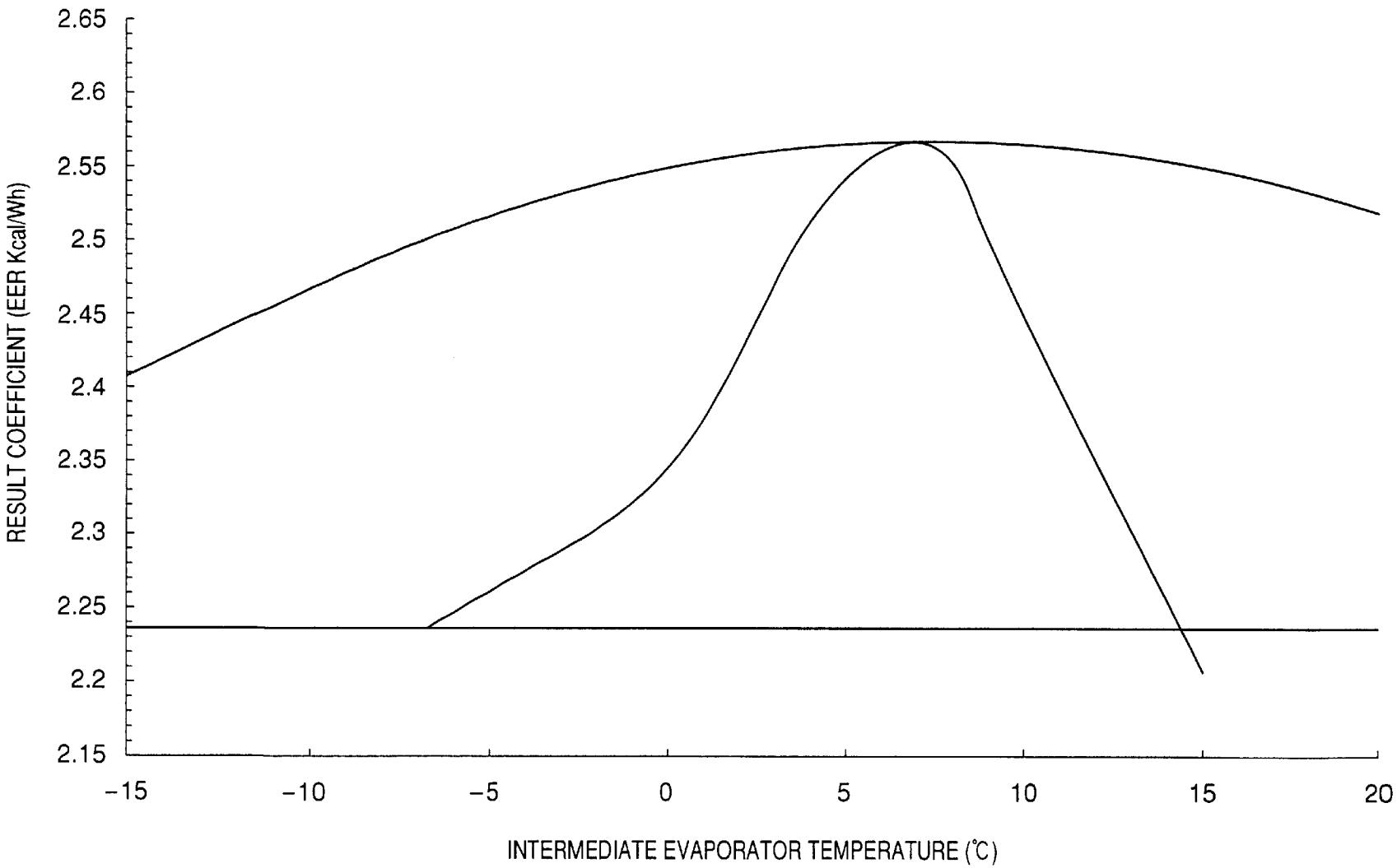
FIG. 6 is another graph similarly showing the relationship of the refrigerant temperature in the intermediate evaporator and the result coefficient.

Specifically, in the present invention, since the refrigerant temperature in the intermediate evaporator 42 is set in the range of −10° C. to +25° C. as described above based on the relationship of the refrigerant temperature in the intermediate evaporator 42 and the result coefficient shown in FIG. 5 or 6, the result coefficient can remarkably be improved as compared with the one-stage compressing refrigeration device shown in the lowermost portion of FIG. 6.

Moreover, as clearly seen from FIG. 4, the result coefficient exhibits the mountain-shaped characteristic with the vicinity of displacement volume ratio D2/D1 of 30% being its peak, but in the present invention the displacement volume ratio D2/D1 is set in the range of 0.35±0.15. Therefore, the result coefficient is further improved as compared with the one-stage compressing refrigeration device, and efficiency can be enhanced.

Additionally, in the embodiment the low-stage compressing means and the high-stage compressing means are constituted using the compressor provided with a plurality of rotary cylinders in the single closed container, but the invention is not limited to the constitution. The low-stage and high-stage compressing means may be constituted using two compressors of single-cylinder type. Moreover, the two-stage compressing refrigeration device has been described in the embodiment, but the present invention is not limited to the device. The present invention can effectively be applied to the compression in three, four, or multiple stages.

As described above in detail, according to the present invention, the low-stage compressing means and the high-stage compressing means, the condenser, the first expanding means, the intermediate evaporator, the second expanding means and the main evaporator constitute a refrigeration cycle. The refrigerant flowing out of the condenser is branched to one refrigerant passed to the intermediate evaporator via the first expanding means and the other refrigerant passed to the main evaporator via the second expanding means. Additionally, the refrigerant flowing out of the main evaporator is sucked by the low-stage compressing means, and the refrigerant flowing out of the intermediate evaporator is sucked by the high-stage compressing means together with the refrigerant discharged from the low-stage compressing means. Therefore, while the torque fluctuation in one compressing operation in the compressor C is suppressed, a high compression ratio can be obtained. Additionally, the temperature of the gas refrigerant sucked by the high-stage compressing means can be lowered, and input can be reduced. Moreover, the temperature of the gas refrigerant discharged from the high-stage compressing means is also lowered. For example, even when ester oil is used as the lubricating oil, the generation of POE problem and the deterioration of lubricating properties can be prevented.

Especially, since the heat exchange is performed between the refrigerant flowing into the second expanding means and the intermediate evaporator, the refrigeration effect relative to the refrigerant circulation amount in the main evaporator is increased. Therefore, efficiency can be enhanced.

Moreover, since the refrigerant temperature in the intermediate evaporator is set in the range of −10° C. to +25° C., the result coefficient can remarkably be improved as compared with the one-stage compressing refrigeration device.

Furthermore, since the ratio D2/D1 of the displacement volume D1 of the low-stage compressing means and the displacement volume D2 of the high-stage compressing means is set in the range of 0.35±0.15, the result coefficient is further improved as compared with the one-stage compressing refrigeration device, and efficiency can be enhanced.

Figure 7:
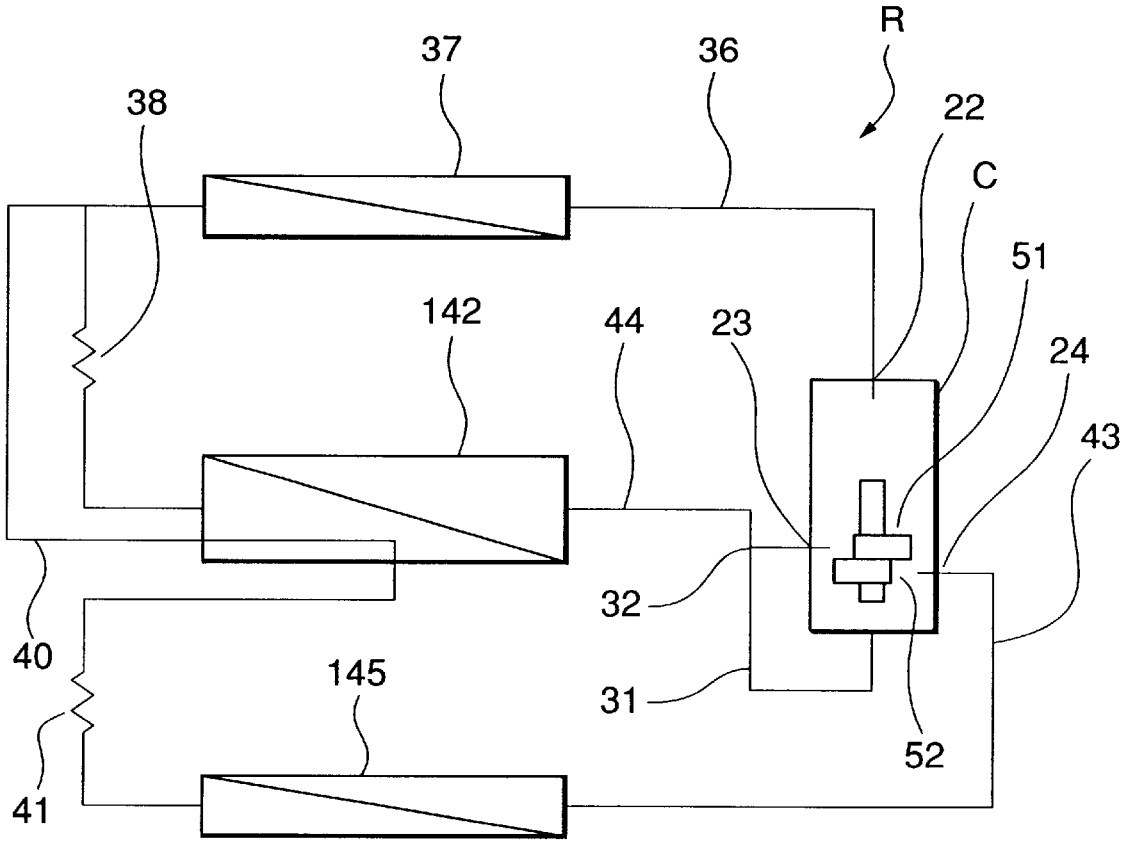
FIG. 7 is a refrigerant circuit diagram of the multi-stage compressing refrigeration device for use in a refrigerator of the present invention.

FIG. 7 is a refrigerant circuit diagram when the multi-stage compressing refrigeration device R of the present invention is mounted on a refrigerator. In FIG. 7, numeral 142 denotes a cold storage chamber evaporator for cooling a cold storage chamber of the refrigerator, and 145 denotes a freezing chamber evaporator for cooling a freezing chamber of the refrigerator. The refrigerant circuit of the FIG. 7 is the same as the refrigerant circuit of FIG. 1, except that the cold storage chamber evaporator 142 is connected to the position of the intermediate evaporator 42 of the refrigerant circuit of FIG. 1, while the freezing chamber evaporator 145 is connected to the position of main evaporator 45 of the refrigerant circuit of FIG. 1. The same compressor C is used.

Additionally, in this case, in FIG. 3, the main evaporator is replaced with the freezing chamber evaporator, and the intermediate evaporator is replaced with the cold storage chamber evaporator. It goes without saying that the intermediate evaporator temperature in FIG. 5 is replaced with the cold storage chamber evaporator temperature and that the intermediate evaporator temperature of FIG. 6 is replaced with the cold storage chamber evaporator temperature.

In the constitution, the refrigerant is circulated in the evaporators 145 and 142 by one compressor C, and the freezing chamber and the cold storage chamber of the refrigerator can independently be cooled. Additionally, the result coefficient can be enhanced.

However, in order to cool the freezing chamber in the embodiment, each element is set in such a manner that the evaporation temperature of the refrigerant in the freezing chamber evaporator 145 is −20° C. Moreover, since the temperature also needs to be low to some degree in the cold storage chamber evaporator 142 in order to cool the cold storage chamber, the throttle amount of the capillary tube 38 may be selected in such a manner that the refrigerant temperature in the cold storage chamber evaporator 142 is in the range of −10° C. to 0° C.

Figure 8:
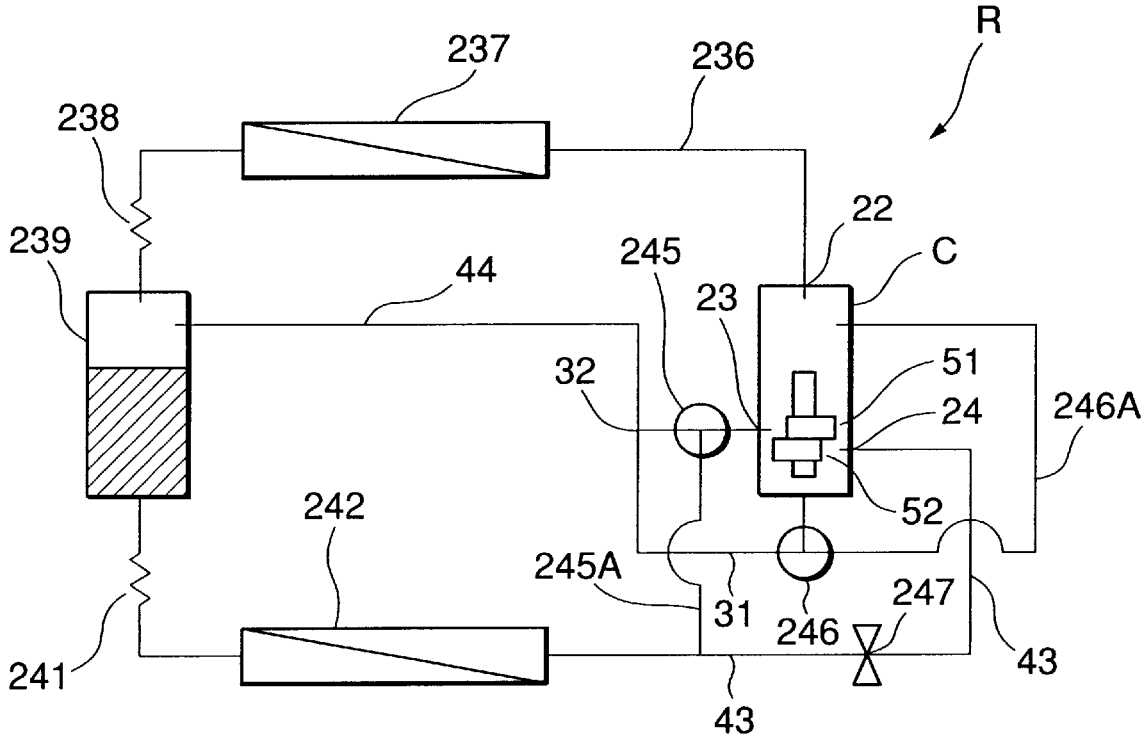
FIG. 8 is a refrigerant circuit diagram of another multi-stage compressing refrigeration device of the present invention.

FIG. 8 shows a refrigerant circuit diagram of another multi-stage compressing refrigeration device R of the present invention. In this case, the compressor C is basically the same as the compressor C shown in FIG. 2.

The refrigerant circuit of the multi-stage compressing refrigeration device R in the embodiment is constituted in such a manner that a first mode M1, a second mode M2, a third mode M3 and a fourth mode M4 can be operated as described later.

In the refrigerant circuit of FIG. 8, the discharge pipe 22 of the compressor C constituting the refrigeration device R is connected to the entrance of a condenser 237 via a piping 236, and a capillary tube 238 as primary expanding means is connected to the exit of the condenser 237. The upper section of a accumulator 239 is connected to the exit of the capillary tube 238, and a capillary tube 241 as secondary expanding means is connected to the lower end of the accumulator 239.

Then, an evaporator 242 is connected to the exit of the capillary tube 241, and the piping 43 connected to the exit of the evaporator 242 is connected to the suction pipe 24 of the compressor C. Furthermore, the branched pipe 44 is connected to the upper section of the accumulator 239, and the branched pipe 44 is inserted into the flow combiner 32 from above and has an open end inside.

Moreover, in the embodiment, a first switching solenoid valve 245 is disposed in the flow combiner 32 of the compressor C of FIG. 2, and interposed before the exit piping 32A. Furthermore, a piping 245A branched from the piping 43 is connected to the first switching solenoid valve 245.

Furthermore, a second switching solenoid valve 246 is disposed in the piping 31, and a piping 246A connected to the second switching solenoid valve 246 is connected and opened into the closed container 1 of the compressor C of FIG. 2. Moreover, a solenoid valve 247 is disposed in the piping 43 on the downstream side from a branched point of the piping 245A. Additionally, the predetermined amount of HFC refrigerant or HC refrigerant such as R-134*a* is similarly sealed in the refrigerant circuit of the multi-stage compressing refrigeration device R, and ester oil, ether oil, HAB oil, mineral oil, or the like is used as the lubricating oil. In the embodiment, however, R-134*a* is used as the refrigerant, and ester oil is used as the lubricating oil.

The flow of the refrigerant to the high-stage compressing section 51 from the flow combiner 32 via the suction pipe 23 can be activated or stopped by switching operation of the first switching solenoid valve 245, and the flow of the refrigerant to the high-stage compressing section 51 from the evaporator 242 via the piping 245A and the suction pipe 23 can be activated or stopped by the switching operation. Furthermore, the flow of the refrigerant from the flow combiner 32 and the flow of the refrigerant from the evaporator 242 can simultaneously stopped by the switching operation of the first switching solenoid valve 245.

Moreover, the refrigerant discharged from the low-stage compressing section 52 can be passed to the flow combiner 32 via the piping 31 or stopped by switching operation of the second switching solenoid valve 246. Additionally, the refrigerant discharged from the low-stage compressing section 52 can be passed into the closed container 1 via the piping 246A or stopped by the switching operation.

Figure 9:
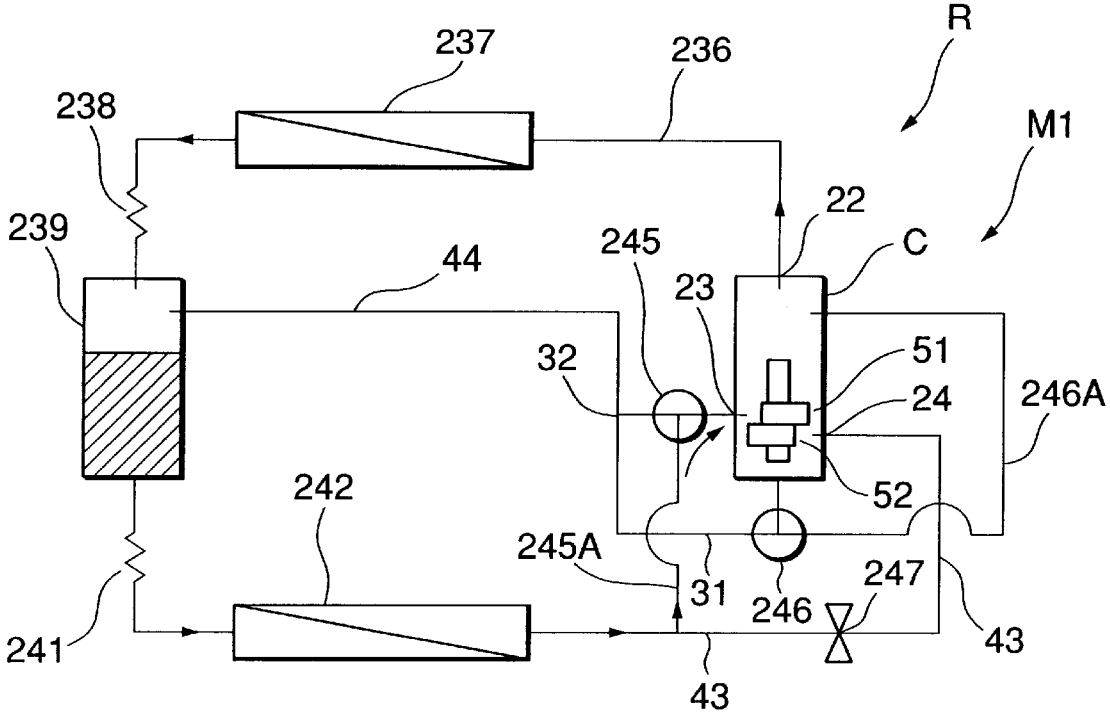
FIG. 9 is a refrigerant circuit diagram showing the refrigerant flow in the first mode of the multi-stage compressing refrigeration device of FIG. 8.

The first mode M1, the second mode M2, the third mode M3 and the fourth mode M4 in the refrigerant circuit constituted as described above will be described. First in the first mode M1, the first switching solenoid valve 245 stops the refrigerant from flowing in from the flow combiner 32, and the refrigerant is passed to the high-stage compressing section 51 from the evaporator 242 via the piping 245A. Moreover, the solenoid valve 247 is closed to stop the refrigerant from flowing toward the low-stage compressing section 52 from the evaporator 242 (FIG. 9).

Figure 10:
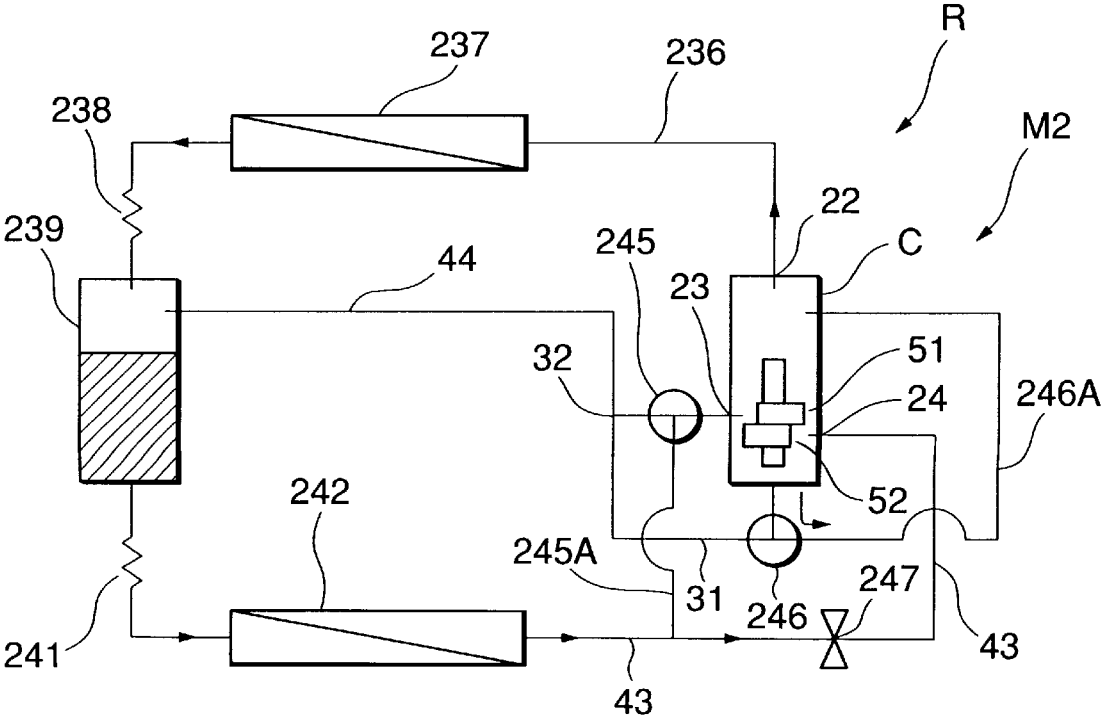
FIG. 10 is a refrigerant circuit diagram showing the refrigerant flow in the second mode of the multi-stage compressing refrigeration device of FIG. 8.

Moreover, in the second mode M2, the solenoid valve 247 is opened to pass the refrigerant toward the suction pipe 24 from the evaporator 242. Additionally, the second switching solenoid valve 246 stops the refrigerant discharged from the low-stage compressing section 52 from flowing into the flow combiner 32 to pass the refrigerant discharged from the low-stage compressing section 52 into the closed container 1 via the piping 246A. Moreover, the first switching solenoid valve 245 is closed to stop the refrigerant from flowing in from the flow combiner 32 and to stop the refrigerant from flowing in via the piping 245A (FIG. 10).

Figure 11:
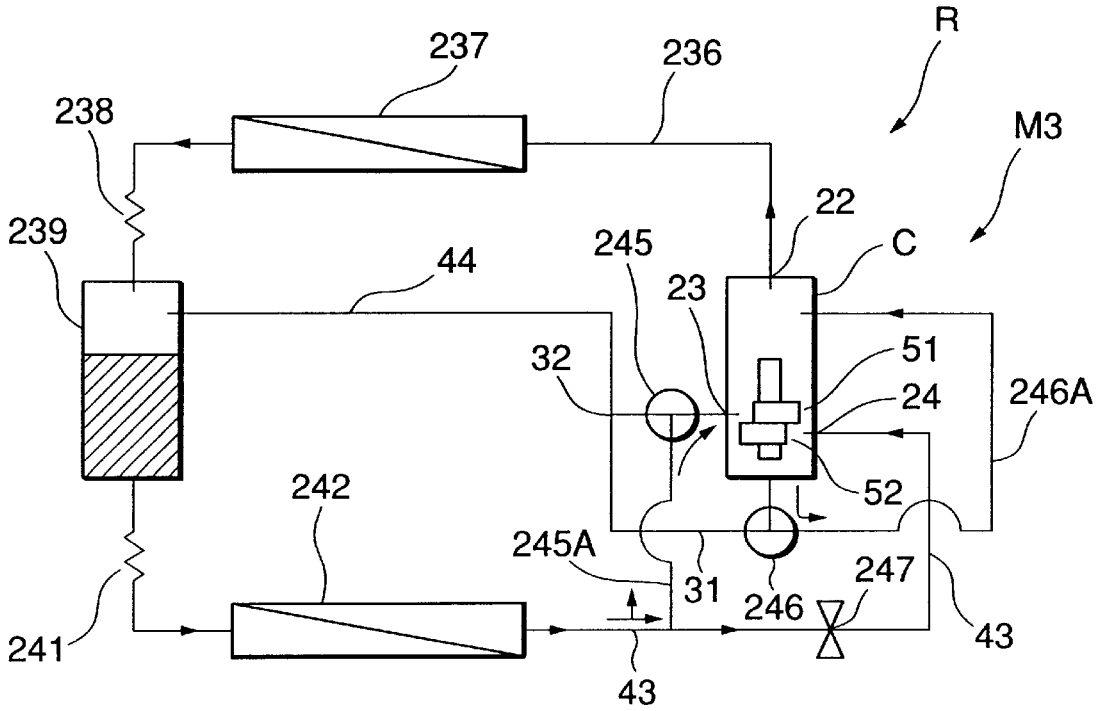
FIG. 11 is a refrigerant circuit diagram showing the refrigerant flow in the third mode of the multi-stage compressing refrigeration device of FIG. 8.

Moreover, in the third mode M3, the first switching solenoid valve 245 stops the refrigerant from flowing in from the flow combiner 32 to pass the refrigerant to the high-stage compressing section 51 from the evaporator 242 via the piping 245A. Additionally, the solenoid valve 247 is opened to pass the refrigerant from the evaporator 242 to the low-stage compressing section 52 via the suction pipe 24. Moreover, the second switching solenoid valve 246 stops the refrigerant discharged from the low-stage compressing section 52 from flowing into the flow combiner 32 to pass the refrigerant into the closed container 1 (FIG. 11).

Figure 12:
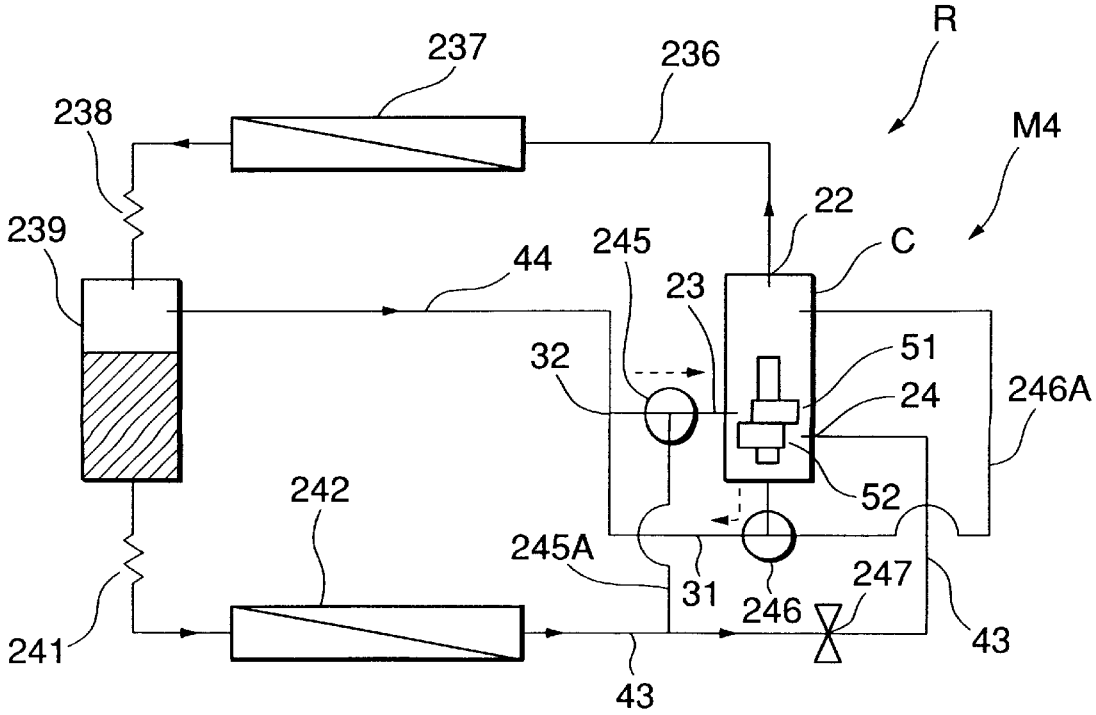
FIG. 12 is a refrigerant circuit diagram showing the refrigerant flow in the fourth mode of the multi-stage compressing refrigeration device of FIG. 8.

Furthermore, in the fourth mode M4, the solenoid valve 247 is opened to pass the refrigerant from the evaporator 242 to the low-stage compressing section 52 via the suction pipe 24. Additionally, the second switching solenoid valve 246 is constituted to pass the refrigerant discharged from the low-stage compressing section 52 to the flow combiner 32 via the piping 31. Moreover, the first switching solenoid valve 245 stops the refrigerant from flowing in via the piping 245A to pass the refrigerant to the high-stage compressing section 51 from the flow combiner 32 (FIG. 12).

The operation of the modes M1, M2, M3, M4 in the aforementioned constitution will next be described. When the electric motor 2 is operated in the first mode M1, the gas refrigerant compressed by the high-stage compressing section 51 is discharged to the discharge muffler 19 via the discharge hole and further discharged into the closed container 1 via the discharge muffler 19. The compressed gas refrigerant discharged into the closed container 1 is discharged to the piping 236 via the discharge pipe 22 to flow into the condenser 237. After heat dissipation and condensation are performed in the condenser 237, the pressure reduction is performed by the capillary tube 238, before the refrigerant flows into the accumulator 239.

Subsequently, only the liquid refrigerant flows to the capillary tube 241 out of the accumulator 239. After pressure reduction is performed, the refrigerant flows into the evaporator 242 to evaporate and fulfill its cooling action. The low-temperature refrigerant flowing out of the evaporator 242 is passed through the first switching solenoid valve 245 via the piping 245A, and sucked by the high-stage compressing section 51 via the suction pipe 23.

Specifically, in the first mode Ml, only the high-stage compressing section 51 is operated for cooling without using the low-stage compressing section 52. Thereby, during nighttime or when outside air temperature is low, the cooling ability is lowered and the power consumption can be suppressed.

Moreover, when the electric motor 2 is operated in the second mode M2, the gas refrigerant compressed by the low-stage compressing section 52 flows to the piping 246A from the second switching solenoid valve 246 and is discharged into the closed container 1. The compressed gas refrigerant discharged into the closed container 1 is discharged to the piping 236 via the discharge pipe 22 to flow into the condenser 237. After the heat dissipation and the condensation are performed, the pressure reduction is performed by the capillary tube 238, before the refrigerant flows into the accumulator 239.

Subsequently, only the liquid refrigerant flows to the capillary tube 241 from the accumulator 239 in the same manner as described above. After the pressure reduction is performed, the refrigerant flows into the evaporator 242 to evaporate and fulfill its cooling action. Subsequently, the low-temperature refrigerant flowing out of the evaporator 242 is sucked again by the low-stage compressing section 52 via the piping 43, the solenoid valve 247 and the suction pipe 24.

Specifically, in the second mode M2, only the low-stage compressing section 52 is operated for cooling without using the high-stage compressing section 51. Thereby, during nighttime or when outside air temperature is low, the cooling ability is lowered and the power consumption can be suppressed in the same manner as the first mode M1.

Moreover, when the electric motor 2 is operated in the third mode M3, the gas refrigerant compressed by the low-stage compressing section 52 is discharged into the closed container 1 from the second switching solenoid valve 246 via the piping 246A. On the other hand, the gas refrigerant compressed by the high-stage compressing section 51 is discharged to the discharge muffler 19 via the discharge hole and further discharged into the closed container 1 via the discharge muffler 19.

The compressed gas refrigerant discharged into the closed container 1 is discharged to the piping 236 via the discharge pipe 22 to flow into the condenser 237. After the heat dissipation and the condensation are performed, the pressure reduction is performed by the capillary tube 238, before the refrigerant flows into the accumulator 239.

Subsequently, only the liquid refrigerant flows to the capillary tube 241 from the accumulator 239 in the same manner as described above. After the pressure reduction is performed, the refrigerant flows into the evaporator 242 to evaporate and fulfill its cooling action. Subsequently, the low-temperature refrigerant flowing out of the evaporator 242 is branched, passed through the piping 43 and the solenoid valve 247, and sucked again by the low-stage compressing section 52 via suction pipe 24.

The other low-temperature refrigerant branched from the evaporator 242 is passed through the piping 245A and the first switching solenoid valve 245, and sucked by the high-stage compressing section 51 via the suction pipe 23. In the closed container 1 the refrigerant discharged from the high-stage compressing section 51 meets the compressed gas refrigerant of the low-stage compressing section 52 discharged into the closed container 1 via the second switching solenoid valve 246 and the piping 246A, and is again discharged to the piping 236 via the discharge pipe 22.

Specifically, in the third mode M3, the operations of the low-stage compressing section 52 and the high-stage compressing section 51 are performed in parallel. Thereby, during pull-down, during daytime, when outside air temperature is high, or at the time of a high load, the displacement volume is increased to maximize the cooling ability.

Moreover, when the electric motor 2 is operated in the fourth mode M4, the low-stage compressing section 52 sucks the refrigerant via the suction pipe 24 to perform compression (first-stage compression), and discharges the refrigerant to the piping 31 via the second switching solenoid valve 246. The one-stage compressed gas refrigerant discharged to the piping 31 is passed through the flow combiner 32 and the first switching solenoid valve 245, and sucked by the high-stage compressing section 51 via the suction pipe 23.

The two-stage compressed gas refrigerant subjected to compression (second-stage compression) is discharged into the closed container 1 via the discharge hole. The two-stage compressed gas refrigerant discharged into the closed container 1 is discharged to the piping 236 via the discharge pipe 22. Subsequently, the refrigerant flows into the condenser 237, in which the heat dissipation and the condensation are performed. Thereafter, the pressure reduction is performed by the capillary tube 238, before the refrigerant flows into the accumulator 239.

Additionally, the throttle amount of the capillary tube 238 is selected in such a manner that the temperature of the saturated gas refrigerant, i.e., the gas-liquid separation temperature is in the range of −5° C. to +25° C.

Subsequently, only the liquid refrigerant flows to the capillary tube 241 from the accumulator 239 in the same manner as described above. After the pressure reduction is performed, the refrigerant flows into the evaporator 242 to evaporate and fulfill its cooling action. Subsequently, the low-temperature gas refrigerant flowing out of the evaporator 242 is passed through the piping 43 and the solenoid valve 247 and sucked again into the low-stage compressing section 52 via the suction pipe 24.

Moreover, the saturated gas refrigerant in the upper section of the accumulator 239 flows out to the branched pipe 44. When the refrigerant is passed through the branched pipe 44 to flow into the flow combiner 32, it meets the one-stage compressed gas refrigerant discharged from the low-stage compressing section 52. Thereafter, the refrigerants are sucked by the high-stage compressing section 51 via the first switching solenoid valve 245 and the suction pipe 23, and compressed. Specifically, in the fourth mode M4 the refrigerant compressed and discharged by the low-stage compressing section 52 is again compressed by the high-stage compressing section 51. While the torque fluctuation in one compressing operation is suppressed, a high compression ratio can be obtained.

Additionally, the throttle amount of the capillary tube 238 is selected in such a manner that the temperature of the saturated gas refrigerant, i.e., the gas-liquid separation temperature is in the range of −5° C. to +25° C.

Subsequently, only the liquid refrigerant flows out toward the capillary tube 241 from the accumulator 239. After the pressure reduction is performed, the refrigerant flows into the evaporator 242 to evaporate. The evaporator 242 fulfills its cooling action by taking heat from its surrounding. The low-temperature gas refrigerant flowing out of the evaporator 242 is then passed through the piping 43 to return to the compressor C, and sucked again by the low-stage compressing section 52 via the suction pipe 24.

Moreover, the saturated gas refrigerant in the upper section of the accumulator 239 flows out through the branched pipe 44, and further flows into the flow combiner 32. After the refrigerant meets the one-stage compressed gas refrigerant discharged from the low-stage compressing section 52, the refrigerants are sucked by the high-stage compressing section 51 via the suction pipe 23, and compressed again. Specifically, when the refrigerant compressed and discharged by the low-stage compressing section 52 is again compressed by the high-stage compressing section 51, the torque fluctuation in one compressing operation is suppressed, while a high compression ratio can be obtained. The ordinary multi-stage compressing refrigeration device R is thus constituted.

In the aforementioned multi-stage compressing refrigeration device R, the low-stage compressing section 52 and the high-stage compressing section 51 of the compressor C, the condenser 237, the capillary tube 238, the accumulator 239, the capillary tube 241 and the evaporator 242 are successively interconnected in a circular shape to constitute a refrigeration cycle. Since the saturated gas refrigerant in the accumulator 239 is sucked into the high-stage compressing section 51 together with the refrigerant discharged from the low-stage compressing section 52, the temperature of the gas refrigerant sucked by the high-stage compressing section 51 can be lowered, and input can be reduced. The temperature of the gas refrigerant discharged from the high-stage compressing section 51 is also lowered. Therefore, even when ester oil is used as the lubricating oil, the generation of POE problem and the deterioration of lubricating properties are prevented.

Figure 13:
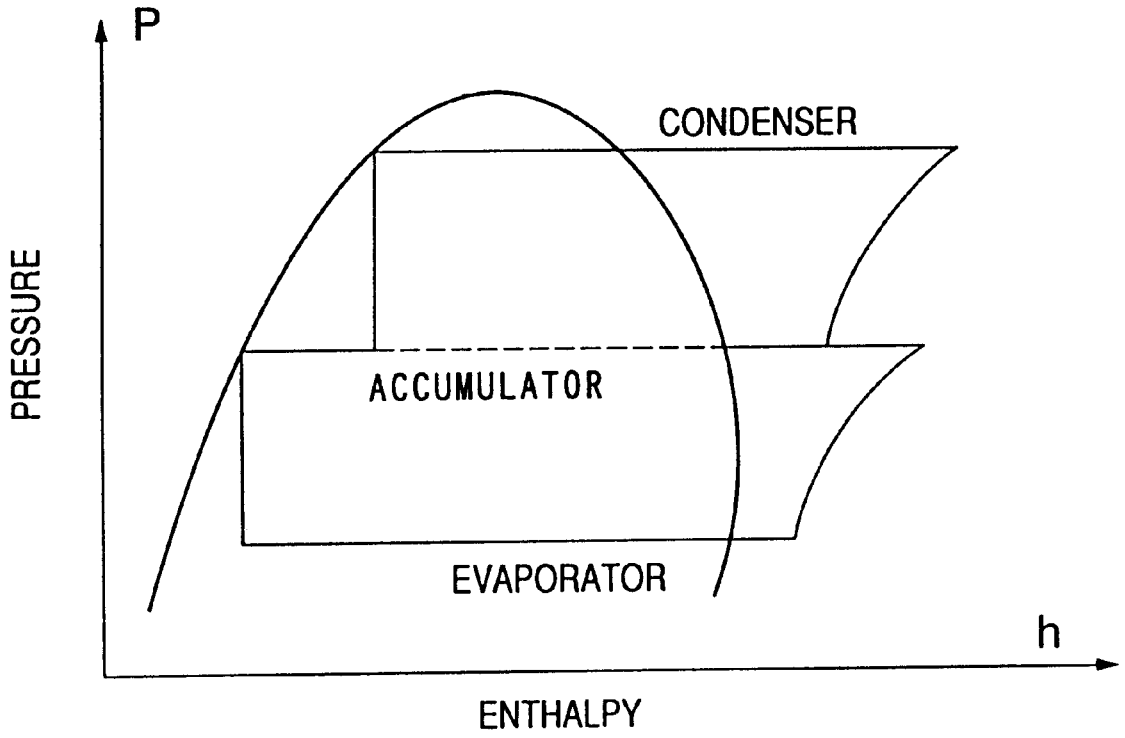
FIG. 13 is Mollier chart of the multi-stage compressing refrigeration device of FIG. 8 in the fourth mode.

Moreover, since the liquid refrigerant in the accumulator 239 is passed through the capillary tube 241 and evaporated in the evaporator 242, the refrigeration effect relative to the refrigerant circulation amount is increased. The efficiency can be enhanced as shown in Mollier chart of FIG. 13.

Here, the relationship of the ratio D2/D1 of the displacement volume D1 of the low-stage compressing section 52 and the displacement volume D2 of the high-stage compressing section 51 and the result coefficient is shown in FIG. 4. As clearly seen from FIG. 4, the result coefficient exhibits a mountain-shaped characteristic with the vicinity of displacement volume ratio D2/D1 of 30% (0.3) being its peak.

Subsequently, the throttle amount of the capillary tube 238 is changed to change the gas-liquid separation temperature in the accumulator 239. When the peak value of the curve of FIG. 4 in each gas-liquid separation temperature is plotted as shown in FIG. 6, a mountain-shaped characteristic is obtained as shown in FIG. 5 or 6. In this case, however, the intermediate evaporator temperature in FIG. 5 or 6 is replaced with the gas-liquid separation temperature.

Specifically, when the gas-liquid separation temperature in the accumulator 239 is set in the range of −5° C. to +25° C. based on the relationship of the gas-liquid separation temperature in the accumulator 239 and the result coefficient shown in FIG. 5 or 6, the result coefficient can remarkably be improved as compared with the one-stage compressing refrigeration device shown in the lowermost portion of FIG. 6.

As described above, the operation of the multi-stage compressing refrigeration device R is constituted to be switched to the first mode M1, the second mode M2, the third mode M3, the fourth mode M4. Therefore, during nighttime, when outside air temperature is low, or at the time of a low load, the power consumption can be suppressed by switching the operation to the first mode M1 or the second mode M2.

Moreover, at the time of a high load, e.g., during the pull-down after the multi-stage compressing refrigeration device R is installed or after frost is removed from the evaporator 242, the operation is switched to the third mode M3, so that the refrigeration ability is maximized while a strong and rapid cooling can be performed. Furthermore, when ordinary operation is performed in the fourth mode M4, the torque fluctuation in one compressing operation is suppressed, while a high compression ratio can be obtained. Therefore, the temperature of the gas refrigerant sucked by the high-stage compressing section 51 is lowered, and input can be reduced. Additionally, the result coefficient is remarkably improved as compared with the one-stage compressing refrigeration device, and efficiency can be enhanced.

As described above in detail, according to the multi-stage compressing refrigeration device R of FIG. 8, the low-stage compressing means, the high-stage compressing means, the condenser, the primary expanding means, the accumulator, the secondary expanding means and the evaporator are successively interconnected in a circular shape to constitute a refrigeration cycle. In the multi-stage compressing refrigeration device, the first mode in which the refrigerant discharged from the high-stage compressing means is successively passed through the condenser, the primary expanding means, the accumulator, the secondary expanding means and the evaporator and sucked into the high-stage compressing means; the second mode in which the refrigerant discharged from the low-stage compressing means is successively passed through the condenser, the primary expanding means, the accumulator, the secondary expanding means and the evaporator and sucked by the low-stage compressing means; the third mode in which the refrigerants discharged from the high-stage compressing means and the low-stage compressing means are successively passed through the condenser, the primary expanding means, the accumulator, the secondary expanding means and the evaporator, branched, and sucked by the high-stage compressing means and the low-stage compressing means, respectively; and the fourth mode in which the refrigerant discharged from the high-stage compressing means is passed through the condenser, the primary expanding means and the accumulator, the liquid refrigerant in the accumulator is passed to the evaporator via the secondary expanding means and sucked into the low-stage compressing means, the refrigerant discharged from the low-stage compressing means is further sucked into the high-stage compressing means, and the saturated gas refrigerant in the accumulator is sucked into the high-stage compressing means together with the refrigerant discharged from the low-stage compressing means can selectively be performed. In general, by setting the operation to the fourth mode, the torque fluctuation in one compressing operation is suppressed, while a high compression ratio can be obtained. Additionally, the temperature of the gas refrigerant sucked by the high-stage compressing means can be lowered, and the input can be reduced. Moreover, the temperature of the gas refrigerant discharged from the high-stage compressing means is also lowered. Therefore, even when ester oil is used as the lubricating oil, the generation of POE problem and the deterioration of lubricating properties can be prevented.

Additionally, since the liquid refrigerant in the accumulator is passed through the secondary expanding means and evaporated in the evaporator, the refrigeration effect relative to the refrigerant circulation amount is increased, so that the efficiency can be enhanced.

Moreover, when the third mode is set at the time of a high load, e.g., during the pull-down after the refrigeration device is installed or after frost is removed from the evaporator, the refrigeration ability can be maximized and the strong and rapid cooling action can be obtained. When the first or second mode is set at the time of a low load, e.g., during nighttime, the power consumption can be suppressed.

Furthermore, since the gas-liquid separation temperature in the accumulator is set in the range of −5° C. to +25° C., especially in the fourth mode, the result coefficient can remarkably be improved as compared with the one-stage compressing refrigeration device.

Additionally, since the ratio D2/D1 of the displacement volume D1 of the low-stage compressing means and the displacement volume D2 of the high-stage compressing means is set in the range of 0.35±0.15, especially in the fourth mode, the result coefficient is further improved as compared with the one-stage compressing refrigeration device, and the efficiency can be enhanced.

What is claimed is:

1. A multi-stage compressing refrigeration device comprising:

a compressor having a drive means, at least a low-stage refrigerant compressing means and a high-stage refrigerant compressing means simultaneously driven by said drive means in a closed container, a refrigeration flow passage to convey the refrigerant compressed by said low-stage compressing means out of said closed container to said high-stage compressing means in said closed container, a condenser to receive and cool the refrigerant compressed by said high-stage compressing means, an intermediate evaporator receiving from the condenser a part of the refrigerant cooled down by said condenser via first expanding means and receiving directly the other part of the cooled down refrigerant;

a second expanding means for receiving the refrigerant from said intermediate evaporator;

a main evaporator to receive the refrigerant from said intermediate evaporator via said second expanding means to be evaporated and supply the evaporated refrigerant back into said low-stage compression means, wherein the expanding ratio of said first expanding means is set to maximize the result coefficient of the refrigeration device.

2. The multi-stage compressing refrigeration device according to claim 1 wherein the refrigerant temperature in the intermediate evaporator is set in the range of −10° C. to +25° C.

3. A refrigerator using the multi-stage compressing refrigeration device of claim 1, comprising a freezing chamber and a cold storage chamber, wherein the main evaporator is used as a freezing chamber evaporator and the intermediate evaporator is used as a cold storage chamber evaporator.

4. The refrigerator using the multi-stage compressing refrigeration device according to claim 3 wherein a refrigerant temperature in the cold storage chamber evaporator is set in the range of −10° C. to +0° C.

5. The multi-stage compressing refrigeration device according to claim 1, 2, 3, or 4, or a refrigerator using the multi-stage compressing refrigeration device according to claims 1, 2, 3 or 4 wherein a ratio D2/D1 of a displacement volume D1 of the low-stage compressing means and a displacement volume D2 of the high-stage compressing means is set in the range of 0.35±0.15.

6. The multi-stage compressing refrigeration device according to claim 1 wherein the refrigerant temperature in the intermediate evaporator is set by controlling the output of said first expanding means.

7. The multi-stage compressing refrigeration device as in claim 6 wherein said first expanding means is a capillary tube.

* * * * *